United States Patent [19]

Barrett

[11] 4,057,946

[45] Nov. 15, 1977

[54] BOTTLE FOR BUILDING CONSTRUCTION

[76] Inventor: Charles W. Barrett, 47616 N. Shore Drive, Belleville, Mich. 48111

[21] Appl. No.: 361,469

[22] Filed: May 18, 1973

[51] Int. Cl.[2] ..... B65D 21/02; E04B 1/12; E04C 1/10

[52] U.S. Cl. ..... 52/436; 52/284; 52/424; 52/591; 52/603

[58] Field of Search ..... 52/436, 591, 405, 306, 52/603, 594, 284, 286; 215/10

[56] References Cited

U.S. PATENT DOCUMENTS

| | | | |
|---|---|---|---|
| 896,780 | 8/1908 | Walzel | 52/405 X |
| 1,413,169 | 4/1922 | Lawton | 52/306 |
| 1,475,714 | 11/1923 | Neumann | 52/594 X |
| 3,012,377 | 12/1961 | Sunukjian | 52/603 X |
| 3,374,917 | 3/1968 | Troy | 215/10 X |
| 3,394,517 | 7/1968 | Caterina | 52/594 X |
| 3,485,355 | 12/1969 | Stewart | 215/10 X |
| 3,587,910 | 6/1971 | McCarthy | 215/10 X |

FOREIGN PATENT DOCUMENTS

| | | | |
|---|---|---|---|
| 1,480,678 | 4/1967 | France | 215/10 |
| 974,305 | 9/1950 | France | 52/436 |
| 1,524,889 | 4/1968 | France | 215/10 |
| 869,392 | 5/1961 | United Kingdom | 215/10 |
| 262,647 | 12/1926 | United Kingdom | 52/436 |
| 9,008 of | 1889 | United Kingdom | 52/591 |

*Primary Examiner*—Alfred C. Perham
*Attorney, Agent, or Firm*—William P. Hickey

[57] ABSTRACT

A modular system of bottles having a predetermined neck configuration and indentations in the bottom and side walls to receive the end of a neck of an abutting bottle to automatically center and space the bottles apart by a distance corresponding to that of a mortar joint. The bottles can be made in full, half, one-quarter, and double sizes, and may include one-third and two-third sizes, etc. The bottles can be laid up into a wall with the mortar joint falling either at the half point, or at the third point.

14 Claims, 16 Drawing Figures

BOTTLE FOR BUILDING CONSTRUCTION

BACKGROUND OF THE INVENTION

Glass bottles are presently made in an endless number of sizes and shapes. After use, these bottles are discarded, since there is no incentive, monitary or otherwise, to transport the bottles back to the manufacturer for refilling, or gather up the bottles and make new bottles. A great number of the bottles, therefore, are thrown away after use to create an ecological problem. At best, these bottles are placed in rubbish cans which are carted to a city dump where they are broken into pieces and the pieces mixed with other refuse. Organic refuse decomposes into a type of soil, but the pieces of glass retain their sharp edges indefinitely to make further use of the dumping area impossible.

An object of the present invention, therefore, is the provision of a new and improved bottle which has a sufficient use in addition to holding liquid contents, that the empty bottle will be retained by the user and used for a building material.

A further object of the invention is the provision of a new and improved bottle which can be used as a glass block and which has built in centering and spacing means which allows a novice to easily produce mortar joints of uniform thickness between the block.

Further objects and advantages of the invention will become apparent to those skilled in the art to which the invention relates from the following description of several preferred embodiments described with reference to the accompanying drawings forming a part of this specification.

DESCRIPTION OF THE PREFERRED EMBODIMENTS

In order that the bottles of the present invention will be put to use rather than be thrown away after the contents are emptied therefrom, they must be capable of a valued use by the average person who has little or no previous craft experience in the intended use. According to the invention, all of the bottles that are made by a manufacturer would be of a standard modular size, and all would have necks of a standard height and end diameter. The bottles contain an indentation in the bottom thereof which will receive and center a standard neck of another bottle of the invention. When so assembled, the bottles are automatically spaced apart by a distance corresponding to a standard mortar joint thickness. Inexperienced personnel, therefore, can place mortar between the bottom of one bottle and the top of another bottle and force the neck into the indentation in the bottom of the other bottle to automatically align the bottles in a row and provide a uniform mortar joint thickness between the bottles. The bottles of the present invention, therefore, provide an easy, do it yourself, arrangement for building assemblages of hollow glass block, one use of which will be the construction of partition walls. In addition to being assembled with their major faces in a horizontal position, the bottles can be assembled with their major faces in a vertical position and their necks facing downwardly; and when so assembled, they will have other uses as for example paving block for sidewalks, patios, and driveways.

Figure 1:
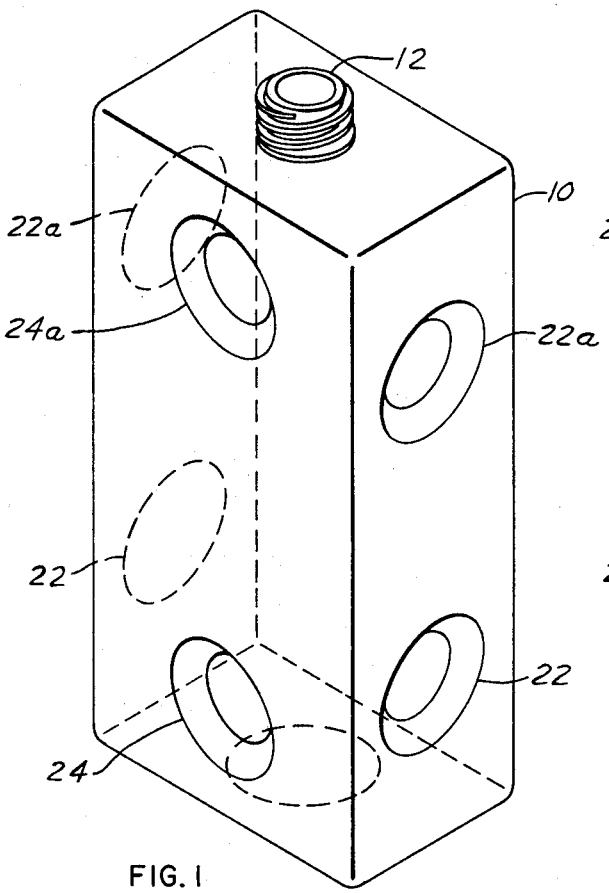
FIG. 1 is an isometric view of a full size modular glass bottle embodying the present invention.

The bottles of the present invention are preferably sized on a modular system that includes a uniform thickness of mortar joint. The various sizes produced will preferably include a half size, a quarter size, and a double size; and may also include a one-third size and a two-third size so that the bottles can be laid up either at the half point, or the third point. FIG. 1 of the drawings shows a full size modular glass bottle 10 having a standard neck 12 on the top thereof and an indentation 14 in the bottom 16 thereof. The indentation 14 is of a depth equal to the height of the standard neck 12 less the standard thickness of mortar joint J. The indentations 14 are such that they include abutment surfaces for engaging the neck 12 on at least three spaced apart points, so as to automatically center the neck 12 when the neck has been inserted to its standard depth. In the embodiment of indentation 14 shown in FIGS. 1–6 of the drawings, the neck is adapted to engage the bottom 18 of the indentation 14 to limit the depth of insertion of the neck, and in addition provide the standard joint mortar thickness. The indentation 14 shown in FIGS. 1–6 is conically shaped, and the bottom 18 thereof is a flat circular surface, so that the conical sidewalls 20 of the indentation 14 center the neck when the end of the neck is in engagement with the bottom surface 18. Still other configurations of indentations can be used, but the conical configuration shown has certain advantages as will later be explained.

Figure 2:
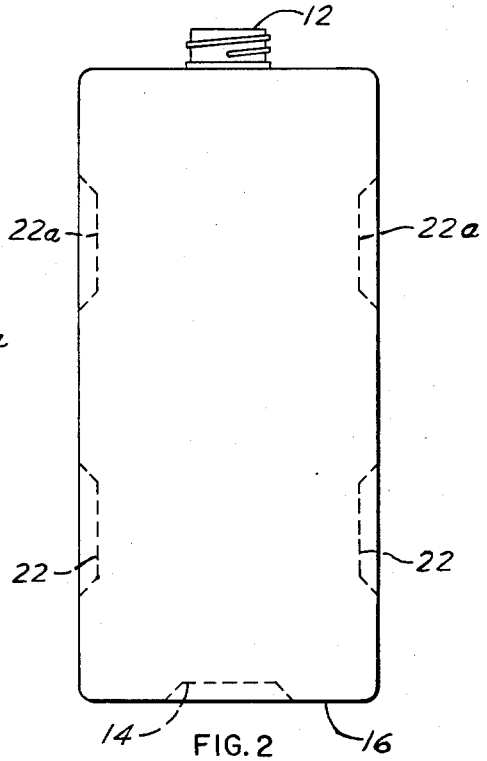
FIG. 2 is a back side view of the bottle shown in FIG. 1.
Figure 8:
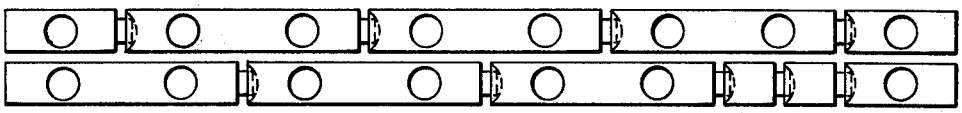
FIG. 8 is an assemblage of full, half and quarter size bottles laid up into a wall with the major faces of the bottles extending horizontally, but without mortar shown between the bottles.
Figure 10:
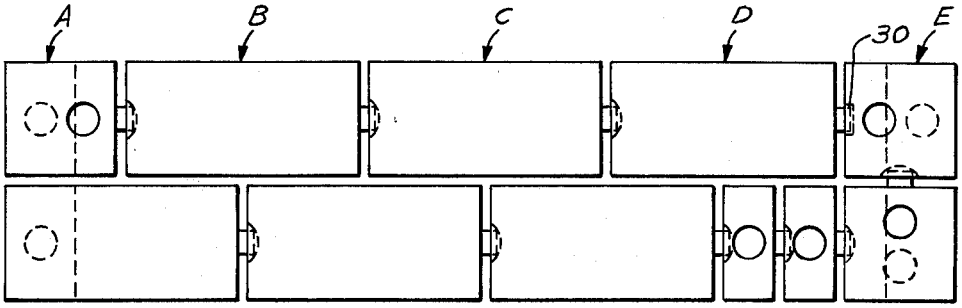
FIG. 10 is an assemblage of full, half and quarter size glass bottles arranged to form a wall with the width of the bottles extending vertically, and without mortar shown between the bottles.

In order that an assemblage of the bottles into a right angle corner can be made with the bottles positioned horizontally, the bottles will also include a second indentation 22 positioned in the narrow side surface of the bottle approximately one-fourth of the height of the body of the bottle from its bottom surface. Another course of bottles can, therefore, be laid at right angles, as shown in FIG. 8, by inserting a neck of a second bottle into the opening 22 of the first bottle to automatically bring the side surface of the second bottle in line with the bottom of the first bottle. In order that the bottles can also be laid into narrow walls with the width of the bottles extending vertically, as shown in FIG. 10, the bottles will preferably also contain a third indentation 24 which is positioned approximately one-sixth of the bottle body height upwardly from the bottom 16 of the bottle. The three indentations so far described i.e. 14, 22 and 24 will allow the bottles to be used substantially in any manner in which bricks are now laid. The remaining two sides of the bottle can be smooth if so desired, or can have openings similar to those already described to provide symmetrical appearance, or further adaptability for receiving the necks of bottles at still other locations. In the embodiment shown in FIG. 1, an opening *22a* is provided in the narrow side surface containing the opening 22, but spaced approximately one-quarter of the bottle body height from its top surface. The opposite narrow side surface also has indentations 22 and *22a*. The front major surface of the bottle contains an additional opening *24a* positioned at the top third point of the front face. The back surface of the bottle as seen in FIG. 2 is plain but could contain a raised indicia i.e. numeral, letter, etc. Different numbers of the openings *22a* as well as *24a* can be used to provide bottles having slightly different capacities.

Figure 4:
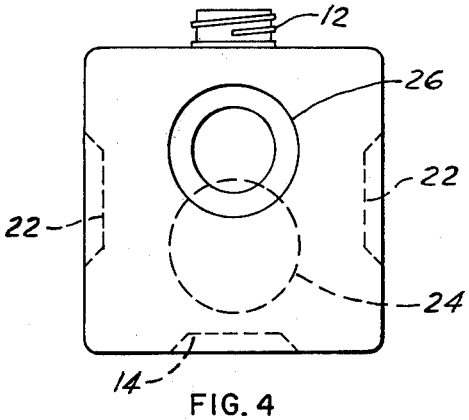
FIG. 4 is a front view of a half size glass bottle embodying the present invention.
Figure 5:
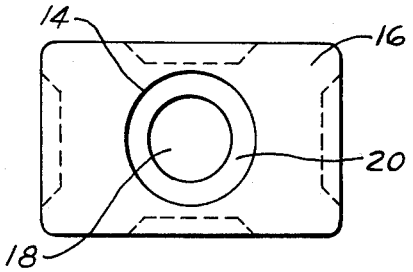
FIG. 5 is a bottom view of the bottles shown in FIGS. 1 through 4.

When the bottles are aligned with their major side surfaces positioned horizontally, there will need be provided a half bottle in alternate courses at each corner, as seen in FIG. 8. It is anticipated, therefore, that the bottles will also be made in half modular size, having a body height that is approximately one-half that of the unit modular bottle, being shortened by a slight amount as is necessary to provide an additional mortar joint in the unit modular spacing. Such a bottle is shown in FIG. 4, which includes the indentations 22 and 24 previously described, as well as the neck 12 and bottom indentation 14 also previously described. The indentations 22 and 24 are spaced from the bottom surface 16 by the same distance as are the openings 22 and 24 of the large size bottle. In addition, the bottle contains an opening 26 that is spaced one third of its height from its top surface.

Figure 3:
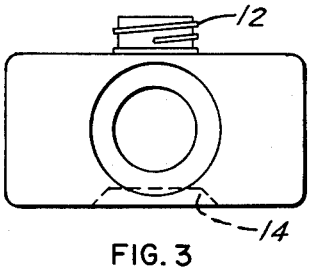
FIG. 3 is a front view of a quarter size glass bottle embodying the present invention.

It is further intended that the bottles will be made in a one-quarter modular size, as seen in FIG. 3, and a double size bottle (not shown). The one-quarter modular size bottle has a height which corresponds generally to one-quarter of the height of the unit modular bottle minus one half of the thickness of a mortar joint. Those portions of the bottles which are identical are designated by a like reference numeral.

Figure 7:
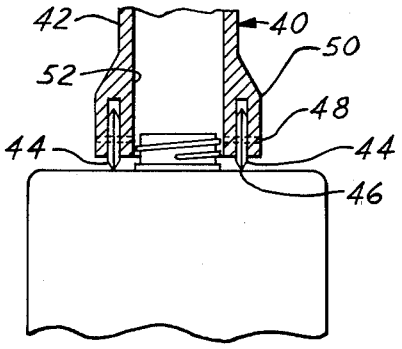
FIG. 7 is a fragmentary sectional view showing a preferred embodiment of cutting tool for removing a neck of the bottles of the present invention.

FIG. 10 of the drawings indicates the manner in which the bottles can be assembled with their width positioned vertically and having a right angle end corner. The neck of the one half size bottle A in the upper left hand corner is inserted into the indentation 14 of the succeeding bottle B to its right, and the succeeding bottle C in turn has its neck 12 inserted into the bottom opening 14 of the bottle D. The neck 12 of the bottle D is inserted into an opening 30 in the succeeding right angle bottle E. The opening 30 is made by removing the neck 12 from the one half size bottle E with the neck removing tool 40 shown in FIG. 7.

Figure 6:
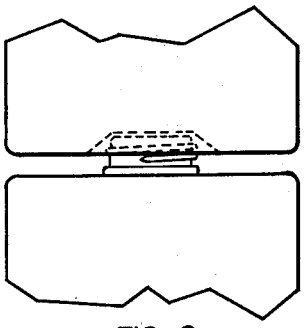
FIG. 6 is a fragmentary sectional view showing how the neck of one bottle embodying the present invention is received in an end indentation in another bottle embodying the present invention.

The tool 40 generally comprises a tubular body member 42 having a pair of hardened glass cutting wheels 44 mounted on the lower end of the tubular body 40. The cutting elements 44 are round wheels having a peripherial sharp cutting edge 46 and oppositely extending axles 48. One of the axles is received into an opening in the bottom of the body member 42 and the outwardly extending axle is positioned in an opening of an arm 50 that is carried by the tubular body 42. The two cutting elements 44 are preferably positioned diametrically opposite from each other, and the central opening 52 of the cutting tool 40 has a sliding fit with the standard neck 12, so that the neck 12 acts as a pilot for the cutting tool 40. The cutting tool 40 is positioned over the neck 12 and rotated so that the cutting wheels 44 scratch a circle in the top of the bottle surrounding the neck 12. Thereafter the neck is tapped by a suitable object, as for example a hammer, to crack the bottle in a circle surrounding the neck, and thereby provide the opening 30 previously referred to. The opposite end of the right angle bottle 10 has the usual indentation 14 therein which will receive the neck of a succeeding bottle. The process can be repeated and only occasionally will it be necessary to remove a neck in the manner above described so as to avoid the necessity of a neck projection from the exterior surface of the wall being made. FIG. 6 of the drawings shows the manner in which a neck 12 is normally automatically centered in an indentation 14 to provide a mortar joint thickness J.

Figure 9:
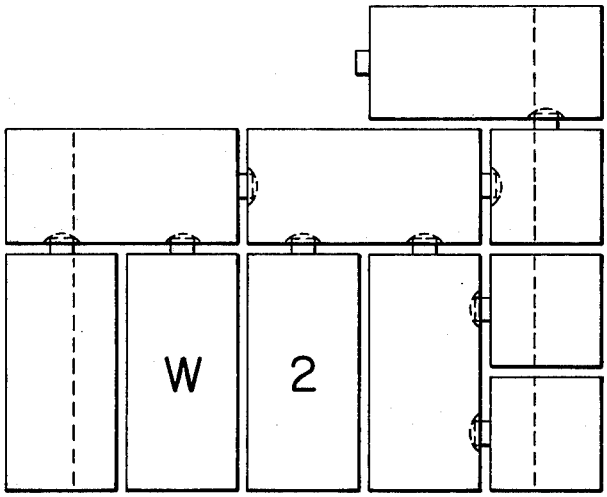
FIG. 9 is an assemblage of full and half size bottles laid up into a wall with the lower course full size bottles standing on their bottoms and with their surfaces devoid of indentation facing the viewer.

FIG. 9 of the drawings shows a wall made with the major face of the lower layer of bottles positioned vertically. The second course of bottles is positioned horizontally with the openings 22 and *22a* being used to receive the necks of the first course of bottles. Half size bottles are used at the right end of the lower course with their necks extending into openings 22 and *22a* of the adjacent vertical bottle. A half size bottle is also used at the right end of the second course. Its neck extends vertically and the neck of the bottle on its left side is received in a side indentation 22 of the half size bottle. In laying patios, sidewalks, etc, the bottles are preferably stood on their narrow sides similar to that shown in FIG. 10, but in a single layer.

The bottles sizes are preferably established on a modular system, the unit length of which will be dependent upon the unit length of bottle plus one mortar joint thickness. The major height "L" of the bottle body, therefore, will equal the modular length minus a joint thickness "J." . In the preferred modular system, the width of the bottle will equal (L/2) − (J/2), and the thickness of the bottle will preferably be equal to (L/3) − (J/2). A half modular size bottle will have a height of (L/2) − (J/2), a one-quarter modular bottle will have a height of (L/4) − (J/2), and a one-third modular bottle will have a height of (L/3) − (J/2). In such a system a two-thirds modular bottle will have a height of (2L/3) − (J/2). The depth "*d*" of an indentation will equal the height "*h*" of the standard neck minus a joint thickness J. In one of the preferred modular systems, L is selected to give a bottle having a capacity equal to 1 quart when it includes the seven indentations previously described.

When the bottle is provided with any of the additional indentations, it can be made to have a bottle cavity corresponding to 1/5 of a gallon. The half modular size bottle will have a capacity approximately equal to a pint, and the one-quarter modular bottle will have a capacity equal to approximately one half a pint. The number of indentations can be decreased in the full size bottle to give a capacity of 40 oz. or ¼ of 1 imperial gallon. The number, type, and/or size of indentations can be varied in each of these bottles to provide additional variations in capacity. In the preferred embodiment of bottle shown in the drawing, L is 8¼ inches, W is 4 inches, T is 2⅝ inches, the pint bottle has a height of 4⅛ inches, and the half pint has a height of 1 15/16 inch.

The bottles of the invention are preferably produced in bottle making molds which separate on a parting line that passes through opposing side corners and diagonally across the top and bottom. In order that the bottles can be removed from the mold, the adjacent side surfaces of the indentations 22 and 24 must be slightly less than parallel with the direction of mold separation so that they form an angle whose apex lies outwardly of the bottle, and the molds must be caused to move apart along the bisector of this angle. The sidewalls of the indentations 14, should form a cone whose apex is equal to or greater than 90°.

Figure 11:
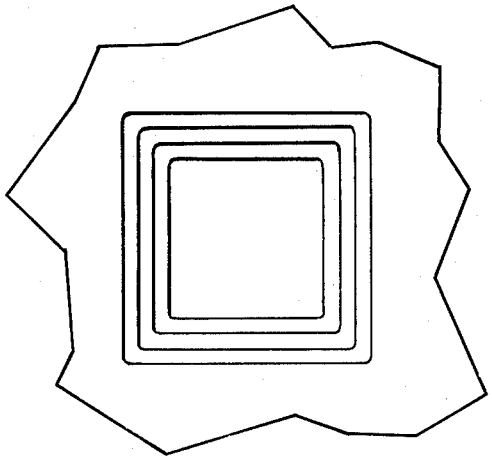
FIG. 11 is a fragmentary elevational view of a square shaped indentation which can be used to receive the neck of the bottles and reduce the internal contents of the bottle by a predetermined amount.
Figure 12:
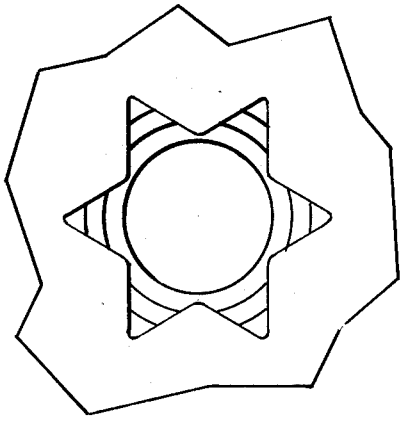
FIG. 12 is a fragmentary elevational view similar to FIG. 11 but showing a star shape of indentation which can be used.
Figure 13:
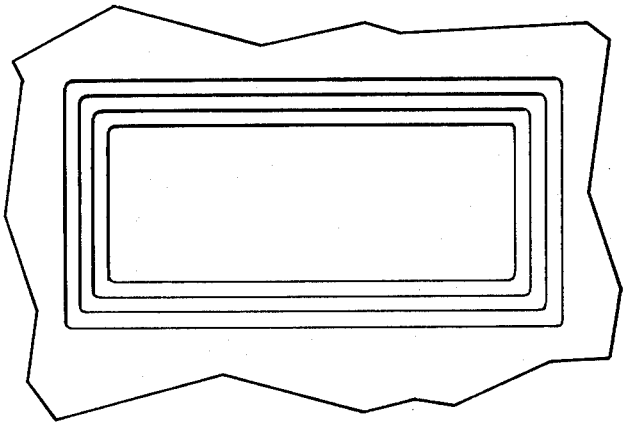
FIG. 13 is a fragmentary elevational view similar to FIG. 11 but showing a rectangular shape indentation.
Figure 14:
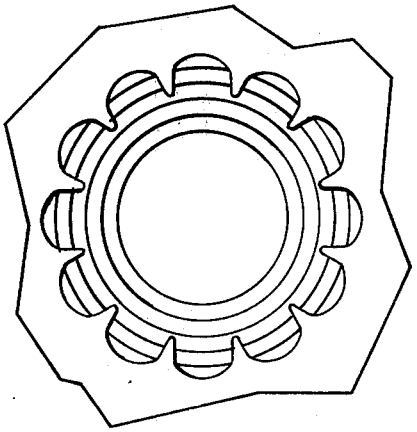
FIG. 14 is a fragmentary elevational view similar to FIG. 11 but showing a daisy shape of indentation.
Figure 15:
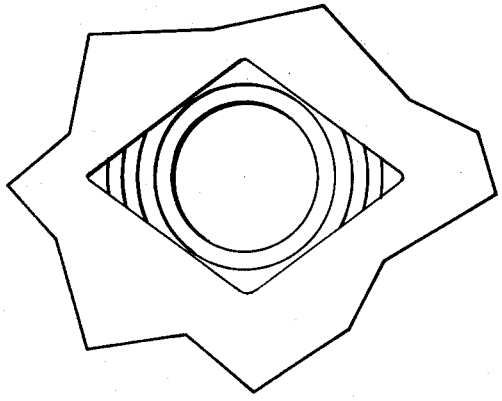
FIG. 15 is a fragmentary elevational view similar to FIG. 11 but showing a diamond shape indentation.

The square shaped indentation shown in FIG. 11 can be used in place of the generally conically shaped indentation 14. The indentation shown in FIG. 11 will center the neck of the bottle and will produce a slightly different reduction in the internal volume of the bottle than will the conical shape of indentation 14. The indentation shown in FIG. 11 has stepped sides for aesthetic reasons. The indentation shown in FIG. 12 is star shaped and has concentric steps giving the appearance of concentric rings. It provides a slightly different reduction in volume than does the square pattern shown in FIG. 11. The indentation shown in FIG. 13 is rectangularly shaped with stepped sidewalls; the indentation of FIG. 14 is daisy shaped with stepped sidewalls; and the indentation shown in FIG. 15 is diamond shaped with stepped sidewalls. The stepped sidewalls provide a pleasing aesthetic appearance and each of the configurations provides a slightly different reduction in the internal contents of the bottle. These different combinations of the different types of indentations can be used to design a bottle of a given predetermined internal volume. For example, a certain combination of the indentations can be used in a full size bottle to produce a bottle whose internal volume is equivalent to a fifth of a gallon; another combination can be used to provide a 40 oz. imperial quart bottle; and, of course, the usual configuration will provide a 1 quart bottle.

Figure 16:
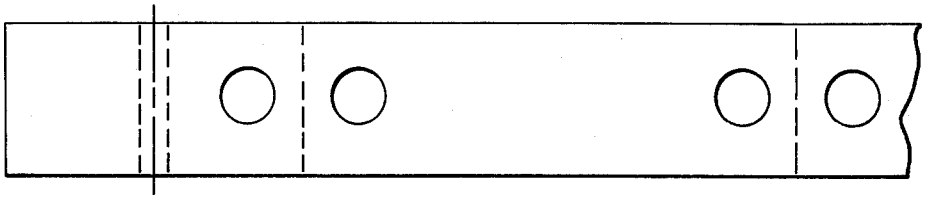
FIG. 16 is a plan view of a coil of mortar joint simulating material which can be used between the bottles previously described.

In the laying up of the bottles into walls, patios, walks, etc. concrete mortar will usually be used. In some instances, however, a rubber, or tar, or organic resin binder can be used. In still other instances, organic foams, as for example, Styrofoam can be used. FIG. 16 shows a partially uncoiled roll of Styrofoam that is preglued on opposite surfaces and covered with removable cover sheets. The roll shown in FIG. 16 corresponds to a width of mortar joint for use along the side edges of the bottles, as shown in FIG. 10, for example; and the tape contains holes therethrough to match the spacing of the openings 22 and **22*a*. Other rolls having openings to match the spacing of the indentations 24 and 24*a*** can be provided, and these strips of simulated mortar joint material can be scribed or otherwise marked for cutting at proper lengths to match the full size bottles.

The bottle of the present invention can be readily adapted to be filled by existing bottle filling machinery. Since the indentation 14 in the bottom lies directly beneath a neck 12, the existing machinery can be modified to include positioning plugs adapted to receive the indentations 14 and center the necks beneath filling spouts. The filling machinery, therefore, which was previously used to center round bottles from their side surface, can be easily modified to fill bottles of the present design. A conveyor so modified is thereafter able to center any of the various size bottles of the same modular system, or which have the same type of bottom indentation.

It will now be apparent that the objects heretofore mentioned have been achieved and that there has been provided a bottle having sufficient utility apart from its normal use of transporting liquids that it will be put to a useful service rather than be cast off about the country side.

It will further be seen that a system of bottle shapes and sizes has been provided which allows the bottles, including an assortment of the various sizes, to be stacked together in a minimum of space to thereby reduce shipping and storage space requirements. Since the bottles require a minimum of shipping space, the amount of packaging materials required is also reduced from that required to ship conventional bottles. Since storage space is reduced, the bottles of the present invention when placed in a refrigerator will save space over that occupied by conventional bottles. The indentations in the bottles promote safety, since they receive the tips of the fingers and prevent slipping from the hand. The bottles can be made of plastic or any other material as well as glass. The bottles may contain numerals or letters on the sides thereof which will make them useful for education purposes, particularly when the bottles are made of plastic. It is envisioned that the bottles made of plastic will become used as toys by children in much the same way as toy blocks are now used. The surface of the bottles may be mottled, serrated or otherwise irregularly contoured on any and all surfaces to make the bottles more opaque, improve mortar joining, or for various other reasons. The bottles can also be made of various colors, or color combinations, to produce various artistic affects when assembled together. It is also envisioned that the bottles can be filled with various materials such as cement, or "adobe" clay and these materials hardened to improve the stiffness of plastic bottles that are to be used as building blocks. In some instances the plastics may be cut away, if desired, to leave the hardened materials, or in the case of "adobe" clay, can be left in place to improve the weathering characteristics of the clay-filled bottles. Returning to the matter of shipping, the shipping cartons need have no empty space therein, and where cushioning materials are used between the bottles, this same cushioning material can be used as partitions between the bottles for simulating mortar joints. Inexperienced personnel can assemble the bottles into a wall, since the bottles are automatically aligned with the proper mortar joint thickness when the neck of one bottle is bottomed in an indentation of another bottle.

While the invention has been described in considerable detail, I do not wish to be limited to the particular embodiments shown and described, and it is my intention to cover hereby all novel adaptations, modifications, and arrangements thereof which come within the practice of those skilled in the art to which the invention relates.

I claim:

1. An assemblage of at least two bottles of generally rectangular cross section having a pair of generally flat opposite side surfaces devoid of projections, said bottles being arranged in end-to-end relationship one of said bottles having a top end having a short uncapped filling neck of predetermined length projecting therefrom, the other of said bottles having a bottom end having a tapered indentation of a depth which is less than said predetermined length of said neck by a mortar joint thickness and which receives the end of said uncapped neck of said one of said bottles, said indentation also having abutment surfaces for engagement by the top side edge of said uncapped neck and which include outwardly tapered side surface portions which when said bottles are not centered will engage the edge of said uncapped neck and move the bottles laterally to bring said generally flat side surfaces flush when said neck is slid down said tapered side abutment surfaces, and material between said bottles in said mortar joint spacing simulating mortar.

2. The assemblage of claim 1 wherein said bottles are arranged in a modular system wherein: L is the bottle body height; J is a mortar joint spacing; the width of the bottle approximates (L/2) − (J/2); and the thickness of the body approximates L/3.

3. The assemblage of claim 1 wherein one of said bottles has a similar indentation in a narrow side surface spaced approximately one-fourth of its body height above the bottom.

4. The assemblage of claim 1 wherein one of said bottles has a similar indentation in a major side surface of the bottle spaced approximately one-sixth of its body height above the bottom.

5. The assemblage of claim 4 wherein said one of said bottles has another one of said indentations in a narrow side surface space approximately one-fourth of its body height above the bottom and with both of said indentations having their surfaces which parallel the height of the bottle and which are adjacent each other forming an angle whose apex is outside of said bottle.

6. A bottle of rectangular cross section having a pair of generally flat opposite side surfaces devoid of projections and a top end, said top end having a short cylindrical uncapped neck of predetermined length projecting therefrom and an opposite end the major portion of which is flat with an indentation therein of a depth that is less than said predetermined neck length by a mortar joint thickness, said indentation having abutment surfaces that include outwardly tapered side portions for engagement by peripherially spaced portions of the top side edge of the uncapped neck of a similar bottle, and said tapered peripherially spaced portions being arranged to bring said flat side surfaces flush when said bottles are spaced by said mortar joint thickness.

7. The bottle of claim 6 having a similar indentation in one of its side surfaces.

8. The bottle of claim 7 wherein said second indentation is positioned in a major side surface spaced approximately one-sixth of its height from said other end.

9. The bottle of claim 7 wherein said second indentation is in a narrow side surface spaced approximately one-fourth of its height from said other end.

10. The bottle of claim 9 having a third indentation in a major side surface, the adjacent surfaces of said side indentations which parallel the height of the bottle forming an angle whose apex is outside of said bottle.

11. The bottle of claim 6 wherein L is the bottle body height, J is a mortar joint spacing, the width of the bottle is approximately (L/2) − (J/2), and the thickness of the bottle is approximately L/3.

12. The bottle of claim 6 wherein $h$ is the length of the neck, J is a predetermined mortar joint width, and the depth of said indentation equals $h$ − J.

13. A bottle having a height L, a width equal to (L/2) − (J/2), and a thickness approximately equal to (L/3) − (J/2) wherein J is a distance corresponding to a mortar joint.

14. A generally rectangular bottle having generally flat ends with a short neck of generally uniform cross section projecting from one flat end and an indentation in the other flat end, said bottle also having at least one side surface devoid of projections and which also has at least one tapered indentation therein, each of said tapered indentations having a depth that is less than said predetermined neck length by a mortar joint thickness and having outwardly tapered side abutment surface portions which are constructed and arranged to be engaged by the upper side edge of an uncapped neck of another similar bottle to center the bottles relative to each other and to space the bottles with the accuracy required of a mortar joint when the uncapped neck of the other bottle is slid down said side abutment surface portions.

* * * * *